US006065996A

United States Patent [19]

Bechaz et al.

[11] Patent Number: 6,065,996

[45] Date of Patent: May 23, 2000

[54] CONNECTOR WITH A STRIPPING SLIT FOR ELECTRICAL WIRE

[75] Inventors: Bernard Bechaz, Caluire; Sylvain Barrat, Belleville sur Saône; Philippe France, Chazelles sur Lyons, all of France

[73] Assignee: Entrelec S.A., Villeurbanne, France

[21] Appl. No.: 09/369,781

[22] Filed: Aug. 6, 1999

[30] Foreign Application Priority Data

Aug. 10, 1998 [FR] France ..... 98 10356

[51] Int. Cl.[7] ..... H01R 4/24

[52] U.S. Cl. ..... 439/409; 439/341; 439/410

[58] Field of Search ..... 439/409, 410, 439/341, 395

[56] References Cited

U.S. PATENT DOCUMENTS

| | | | |
|---|---|---|---|
| 4,541,679 | 9/1985 | Fiedler et al. | 439/409 |
| 4,729,738 | 3/1988 | Heng et al. | 439/395 |
| 4,995,829 | 2/1991 | Geib et al. | 439/409 |
| 5,785,548 | 7/1998 | Capper et al. | 439/409 |

FOREIGN PATENT DOCUMENTS

| | | |
|---|---|---|
| 0243887 | 4/1987 | European Pat. Off. . |
| 0271594 | 6/1988 | European Pat. Off. . |
| 0706234 | 4/1996 | European Pat. Off. . |
| 2447620 | 1/1980 | France . |
| 29802674 | 4/1998 | Germany . |

*Primary Examiner*—Paula Bradley
*Assistant Examiner*—Tho D. Ta
*Attorney, Agent, or Firm*—Ware, Fressola, Van Der Sluys & Adolphson LLP

[57] ABSTRACT

A connector comprises a casing (2) inside which is mounted a conducting piece (9) having a slit (10) for retaining an electrical wire (16). Mounted so as to pivot inside this casing is a cage (8) having a cavity (13) for the engagement of a maneuvering rod and a cavity (15) for the engagement of the conducting wire (16). During the pivoting movement of the cage (8), the wire (16) is stripped locally and introduced into the slit (10), and the cage sits over that end of the conducting piece (9) which has the slit.

7 Claims, 2 Drawing Sheets

CONNECTOR WITH A STRIPPING SLIT FOR ELECTRICAL WIRE

TECHNICAL FIELD

BACKGROUND OF THE INVENTION

The subject of the present invention is a connector with a stripping slit for electrical wire.

The purpose of this connector is to ensure the electrical connection and the immobilization of at least one electrical wire sheathed with insulation, without having to prestrip this wire.

Such connectors are usually employed for connecting wires together, for example in terminal blocks, or for connecting wires to an item of electrical equipment, such as a controller.

It is already known to produce connectors having a stripping slit made in a conducting piece. The slit has, at one of its ends, a flared mouth designed to facilitate the insertion of the wire to be connected into the conducting piece and to make a transverse cut in the insulation surrounding the conducting core of the wire. The wire is presented transversely with respect to the slit and then moved in the longitudinal direction of the slit while keeping the wire in a transverse orientation with respect to the slit.

The conducting core of the wire, after local stripping of the latter, comes into contact with the edges of the slit which immobilize the conducting core by pressing against it and which ensure electrical continuity between the conducting core and the conducting piece.

An electrical wire is inserted into the stripping slit of a conducting piece with the aid of an auxiliary piece which is incorporated into the body having the conducting piece and which moves the wire in the slit after it has passed through the stripping mouth of the latter. This auxiliary piece can be actuated with the aid of a tool, for reasons of ease of access as well as for reasons of scaling down the force that has to be exerted in order to install the wire.

DESCRIPTION OF THE PRIOR ART

Document EP 0,243,887 in the name of the Applicant relates to a connector of this type, comprising at least one conducting piece housed in an insulating casing having an opening, into which each wire is introduced and through which the latter passes, in a wall parallel to the slit of each piece, the casing also serving as the housing for at least one insertion piece which, being mounted in the casing so as to rock and being actuated with the aid of a removable rod which passes through an opening in the casing, is designed to insert a wire into the slit of a conducting piece after the wire has been introduced into the opening in the casing provided for this purpose. This insertion piece bears against the wire and pushes it inside the slit of the conducting piece, this conducting piece consisting of a tubular profiled element slit longitudinally, the longitudinal slit serving specifically to take the wire. It should be noted that it is necessary to have a conducting piece exhibiting good mechanical behavior in order to provide, by virtue of its intrinsic properties, a stripping pressure and a pressure ensuring electrical continuity. This conducting piece therefore has a high manufacturing cost. Furthermore, since the insertion piece is offset with respect to the conducting piece, the volume of the casing is large.

SUMMARY OF THE INVENTION

The object of the invention is to provide a connector with a stripping slit of this type, which can be made in a compact form and with each conducting piece having a simple structure.

For this purpose, in the connector to which the invention relates, the insertion piece consists of a cage mounted so as to pivot inside the casing about a pin perpendicular to the direction of introduction of the wire into the casing, this cage having two cavities oriented toward that wall of the casing which serves for introducing the wire and toward that wall of the casing which lies facing the mouth of the slit, in order to allow, respectively, the introduction of the wire and the introduction of the actuating rod, the face facing the side of the conducting piece of the cage having an opening and the side walls of the cage being spaced apart by a distance corresponding approximately to the width of the conducting piece, the cage being mounted in the casing in such a way that, in the position for introducing the wire into the casing, the cavity for housing the wire is offset axially with respect to the slit of the conducting piece and in such a way that, in the position for inserting the wire, this same cavity lies facing the slit of the conducting piece and the side walls of the cage are on either side of that part of the conducting piece which has the slit, so as to sit over this piece.

The cage making up the insertion piece, since it sits over the conducting piece in the connection position, allows the connector to be made in a compact form. Furthermore, the fact that the cage sits over the conducting piece makes it possible, by suitably dimensioning the cage and the conducting piece respectively, to ensure that the conducting piece is held in position in order to prevent, in particular, the slit, after the electrical wire has been engaged into it, from opening. This therefore allows the construction of the conducting piece to be simplified and lightened.

According to a preferred embodiment, the conducting piece consists of a metal blade in which the slit for housing the wire is made in the length direction of the blade, starting from one end of the latter.

Such a conducting piece is therefore simple and inexpensive to produce.

According to one characteristic of the invention, and so as to allow the conducting wire to move parallel to itself and perpendicularly to the slit during the phases of stripping it and of introducing it into the slit, the cavity of the cage, intended to house the wire, has, seen in a plane perpendicular to the axis of rotation, a trapezoidal general shape with its width decreasing from the outside toward the inside.

In order to help to lock the conducting piece in place after the wire has been introduced into the slit in the latter, the cavity intended for housing the wire has a recess intended for the engagement of the free end of the conducting piece, which recess is made in the wall opposite that allowing this piece to be introduced into the cage.

BRIEF DESCRIPTION OF THE DRAWINGS

In any case the invention will be clearly understood with the aid of the description which follows, with reference to the appended diagrammatic drawing which illustrates, by way of nonlimiting example, one embodiment of this connector.

DESCRIPTION OF THE PREFERRED EMBODIMENT

Figure 1:
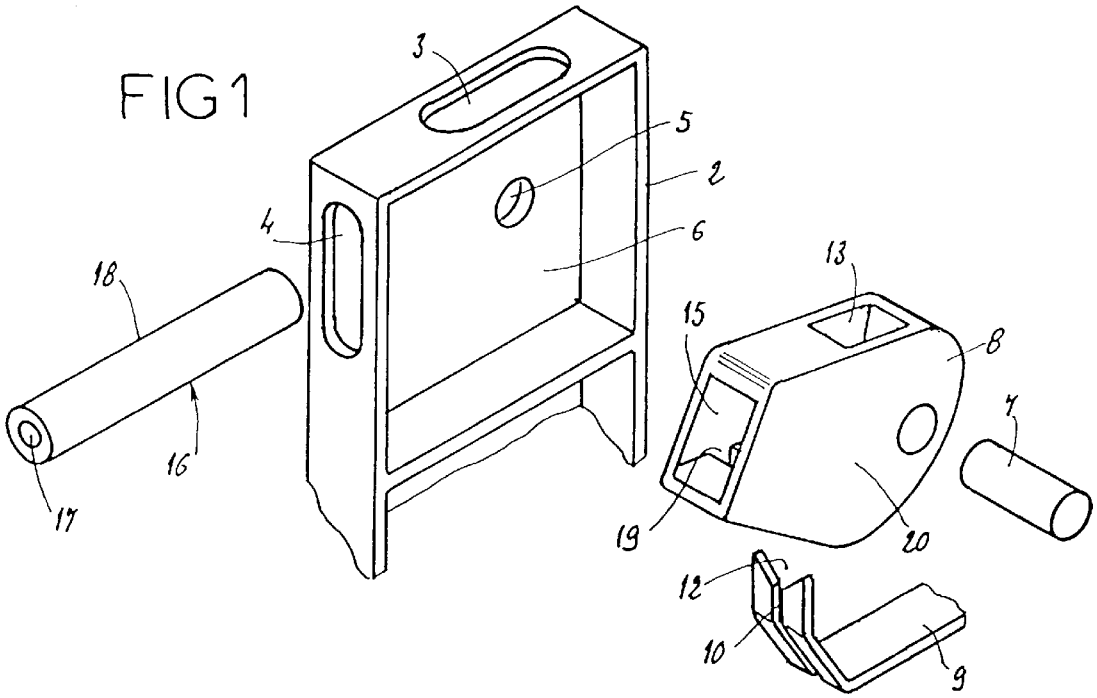
FIG. 1 is an exploded perspective view of the main components of this connector.

The connector is described below in the case of the connection of a conducting wire to a conducting piece. However, it would be possible to envision a similar connector having several series of conducting wires intended to be connected to as many conducting pieces arranged inside the same assembly.

The connector illustrated in the drawing comprises a casing 2, for example made of synthetic material, of parallelepipedal general shape. This casing 2 has an elongate opening 3 in its upper face and an elongate opening 4, of vertical orientation, in one of its side faces. The casing also has two coaxial holes 5 made in its two large lateral faces 6, said coaxial holes 5 being intended for the engagement of a pin 7 for pivoting an insertion piece denoted by the general reference 8. Mounted in the casing 2 is a conducting piece 9 consisting of a metal blade having a slit 10 which terminates in a stripping mouth 12, forming an entrance tapered toward the slit. The slit 10 is made in the length direction of the blade, starting from one end of the latter. This blade has several folds, which in particular define a region for fastening it to the lower face of the casing, and the slit 10. The conducting piece is positioned in the casing in such a way that the mouth 12 and the slit 10 face the lower part of the opening 4 made in one face of the casing. The insertion piece 8 forms a cage having a first cavity 13 which emerges at the top, opposite the opening 3 in the casing. This cavity 13 allows the engagement of a rod 14, consisting of a screwdriver for example, in order to allow the cage to rotate about its pin 7.

The cage 8 has another cavity 15 which emerges opposite the opening 4, this cavity 15 serving for the engagement of one end of a wire 16 having a conducting core 17 surrounded by an insulating sheath 18. The cavity 15 has, seen in a plane perpendicular to the axis of rotation, a trapezoidal general shape with its width decreasing from the outside toward the inside, without ever being less than the cross section of the wire 16.

The cage 8 also has an opening 19 allowing the free end of the conducting piece 9 to pass into the cage, the distance between the side walls of the cage corresponding approximately to the width of the conducting piece, which allows the cage to be able to sit over that part of the conducting piece which has the slit 10 and the stripping mouth 12. Finally, the cavity 15 has, in its wall on the opposite side from the opening 19, a recess 22 which houses the free end of the conducting piece.

Figure 2:
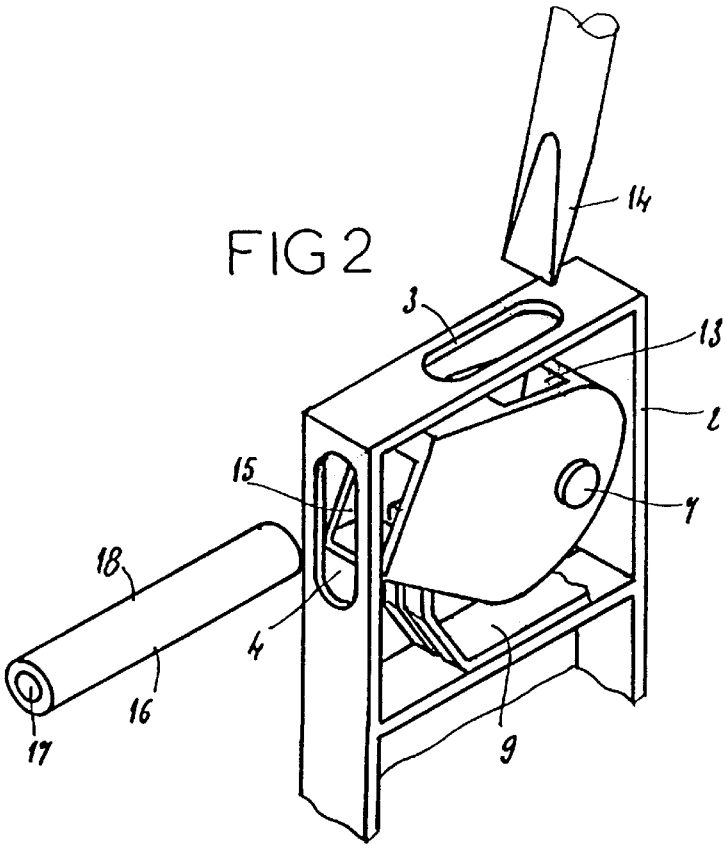
FIG. 2 is a perspective view of this connector before insertion of the conducting wire, the front face of the casing having been removed.
Figure 3:
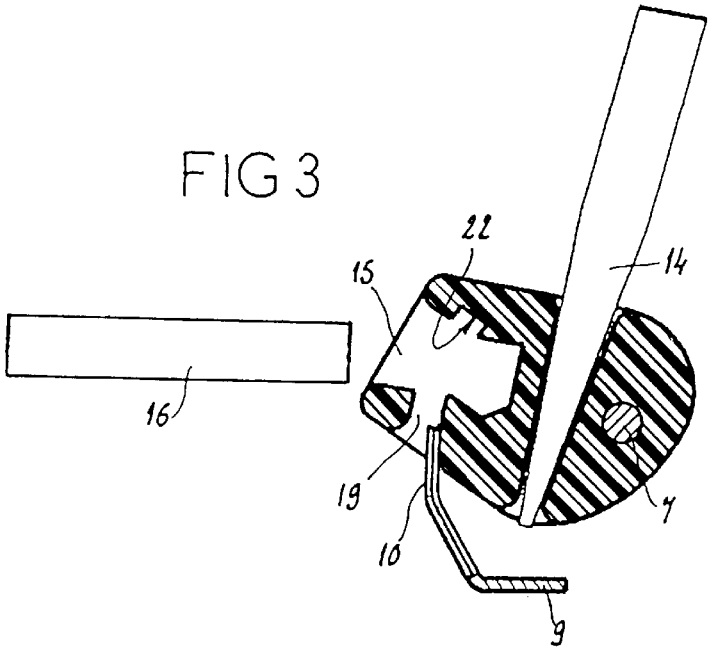
FIGS. 3 and 4 are two longitudinal sectional views of the connector before insertion of the conducting wire and after insertion of the latter, respectively.
Figure 4:
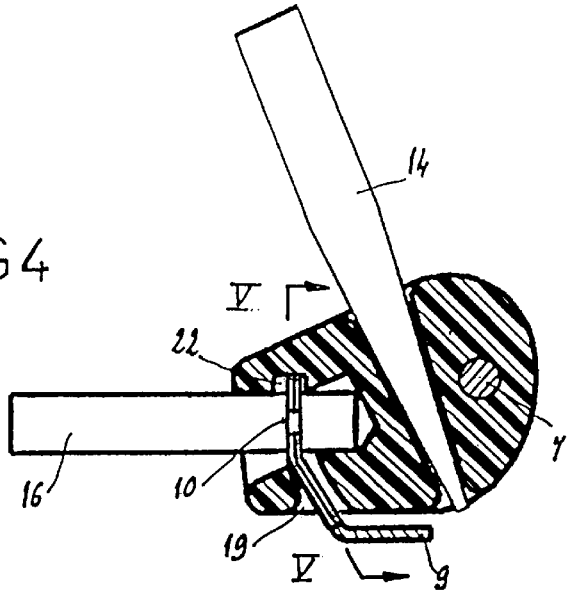
Figure 5:
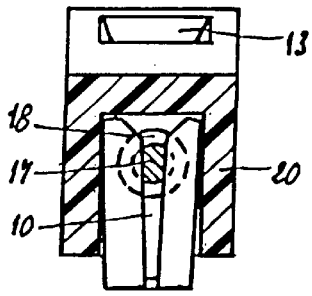
FIG. 5 is a cross-sectional view of the connector on the line V—V in FIG. 4.

Before the wire 16 is connected to the conducting piece 9, the connector is in the position illustrated in FIGS. 2 and 3. The end of the wire 16 is engaged in the cavity 15 of the cage, while a rod, such as the end of a screwdriver blade, is engaged in the cavity 13 of the cage. The operator, by acting on the rod 14, then pivots the cage 8 anticlockwise, during which movement the wire 16 is moved parallel to itself, and introduced into the stripping mouth, which will cut the insulation locally, and then inserted between the two lips of the slit 10 in order to provide electrical continuity between the conducting core 17 of the wire 16 and the conducting piece 9. During this movement, the cage sits over the end region of the conducting piece 9 and ensures as it were that the latter is locked in place, avoiding any risk of the wire 16 becoming unfastened from the conducting piece, since, and as shown in FIGS. 4 and 5, the end of the conducting piece is engaged in the recess 22 of the cavity 15 of the cage 8 and the two parts of the conducting piece 9 defining the slit 10 are unable to move apart since they are bearing against the side walls 20 of the cage.

As is apparent from the foregoing, the invention provides a great improvement over the prior art by providing a connector with a stripping slit which has a very compact structure, is very practical and very reliable to use and allows the use of a conducting piece which is of simple shape and inexpensive.

Needless to say, the invention is not limited to the single embodiment of this connector that has been described above by way of example—on the contrary, it embraces all variants thereof. Thus, in particular, this connector could have a cage intended for the simultaneous insertion of several wires into several slits in conducting pieces without thereby departing from the scope of the invention.

What is claimed is:

1. A connector for electrically connecting and mechanically retaining an insulated electric wire (16), comprising at least one conducting piece (9) with an immobilizing slit (10) for the wire (16), one end of which has a stripping mouth (12), the at least one conducting piece is housed in an insulating casing (2) having an opening (4), into which each wire is introduced and through which the latter passes, in a wall parallel to the slit (10), the casing also serving as the housing for at least one insertion piece (8) which, being mounted in the casing so as to rock and being actuated with an aid of a removable rod (14) which passes through another opening in the casing, the at least one conducting piece is designed to insert the wire into the slit of the at least one conducting piece after the wire has been introduced into the opening (4) in the casing provided for this purpose, wherein the at least one insertion piece (8) consists of a cage mounted so as to pivot inside the casing (2) about a pin (7) perpendicular to the direction of introduction of the wire (16) into the casing, wherein the pin is mounted to the casing and the cage, this cage having a first cavity (15) oriented toward a wall of the casing which serves for introducing the wire and a second cavity (13) oriented toward a wall of the casing which lies facing the stripping mouth of the slit, in order to allow, respectively, the introduction of the wire (16) and the introduction of the actuating rod (14), wherein the side walls (20) of the cage are spaced apart by a distance corresponding approximately to the width of the at least one conducting piece (9), the cage being mounted in the casing in such a way that, in the position for introducing the wire (16) into the casing, the first cavity (15) for housing the wire is offset axially with respect to the slit (10) of the at least one conducting piece (9) and in such a way that, in the position for inserting the wire, this first cavity (15) lies facing the slit (10) of the at least one conducting piece (9) and the side walls (20) of the cage are on either side of that part of the at least one conducting piece (9) which has the slit (10), so as to sit over this slit (10) of the at least one conducting piece.

2. The connector as claimed in claim 1, wherein the first cavity (15) intended for housing the wire (16) has a recess (22) intended for the engagement of a free end of the at least one conducting piece (9), wherein the recess is made in a wall of the first cavity opposite another wall of the first cavity that allows the at least one conducting piece to be introduced into the cage.

3. The connector as claimed in claim 1, wherein the at least one conducting piece (9) consists of a metal blade in which the slit (10) for housing the wire is made in the length direction of the blade, starting from one end of the latter.

4. The connector as claimed in claim 1, wherein the first cavity (15) of the cage, intended to house the wire, has, as seen in a plane perpendicular to the axis of rotation, a trapezoidal general shape with its width decreasing from the outside toward the inside.

5. The connector as claimed in claim 4, wherein the at least one conducting piece (9) consists of a metal blade in which the slit (10) for housing the wire is made in the length direction of the blade, starting from one end of the latter.

6. The connector as claimed in claim 4, wherein the first cavity (15) intended for housing the wire (16) has a recess (22) intended for the engagement of a free end of the at least one conducting piece (9), wherein the recess is made in a wall of the first cavity opposite another wall of the first cavity that allows the at least one conducting piece to be introduced into the cage.

7. The connector as claimed in claim 3, wherein the at least one conducting piece (9) consists of a metal blade in which the slit (10) for housing the wire is made in the length direction of the blade, starting from one end of the latter.

* * * * *